US011021285B2

(12) United States Patent
Lokkers et al.

(10) Patent No.: US 11,021,285 B2
(45) Date of Patent: Jun. 1, 2021

(54) APPARATUS FOR PACKAGING DOSED QUANTITIES OF SOLID DRUG PORTIONS

(71) Applicant: BD Switzerland Sàrl, Eysins (CH)

(72) Inventors: Eddy R. Lokkers, Espeet (NL); John Van De Koot, Doornspijk (NL)

(73) Assignee: BD SWITZERLAND SÀRL, Eysins (CH)

( * ) Notice: Subject to any disclaimer, the term of this patent is extended or adjusted under 35 U.S.C. 154(b) by 157 days.

(21) Appl. No.: 16/277,688

(22) Filed: Feb. 15, 2019

(65) Prior Publication Data

US 2019/0177018 A1 Jun. 13, 2019

Related U.S. Application Data

(63) Continuation of application No. 14/424,494, filed as application No. PCT/EP2013/067523 on Aug. 23, 2013, now Pat. No. 10,252,826.

(30) Foreign Application Priority Data

Aug. 31, 2012 (EP) ..... 12182632

(51) Int. Cl.
*B65B 35/00* (2006.01)
*B65B 39/00* (2006.01)
(Continued)

(52) U.S. Cl.
CPC ..... *B65B 35/30* (2013.01); *B65B 9/06* (2013.01); *B65B 35/24* (2013.01); *B65B 39/007* (2013.01);
(Continued)

(58) Field of Classification Search
CPC ..... B65D 83/04; B65B 35/46; B65B 39/007; B65B 35/24; B65B 35/26; B65B 35/00
(Continued)

(56) References Cited

U.S. PATENT DOCUMENTS 3,028,713 A 4/1962 Kennedy et al.
3,139,713 A 7/1964 Merrill et al.
(Continued)

FOREIGN PATENT DOCUMENTS

CN 102319695 A 1/2012
EP 1612146 A1 1/2006
(Continued)

OTHER PUBLICATIONS

International Search Report dated Oct. 30, 2013 for International Application No. PCT/EP2013/067523.
(Continued)

*Primary Examiner* — Gloria R Weeks
(74) *Attorney, Agent, or Firm* — Morgan, Lewis & Bockius LLP

(57) ABSTRACT

An apparatus for dispensing and packaging dosed quantities of solid drug portions is provided. The apparatus includes multiple dosing stations, each dosing station having an output opening for dispensing solid drug portions, a collector for collecting dosed quantities of solid drug portions dispensed by the dosing stations and forwarding the dosed quantities of solid drug portions to a packager, and multiple fall ducts configured to guide the solid drug portions from the output openings to the collector, each fall duct having an outlet and a number of inlet openings, the output openings of the dosing stations being aligned with the inlet openings of the fall ducts when a fall duct is positioned adjacent to a column of dosing stations. Each fall duct includes a first part and a second part detachably connected together.

19 Claims, 13 Drawing Sheets

(51) Int. Cl.

| | |
|---|---|
| ***B65B 35/30*** | (2006.01) |
| ***B65B 59/04*** | (2006.01) |
| ***B65B 65/06*** | (2006.01) |
| ***B65B 65/08*** | (2006.01) |
| ***B65B 9/06*** | (2012.01) |
| ***B65B 35/24*** | (2006.01) |

(52) U.S. Cl.
CPC ..... *B65B 59/04* (2013.01); *B65B 65/06* (2013.01); *B65B 65/08* (2013.01); *B65B 2210/08* (2013.01)

(58) Field of Classification Search
USPC ..... 53/154, 237; 221/123
See application file for complete search history.

(56) References Cited

U.S. PATENT DOCUMENTS

| | | | | |
|---|---|---|---|---|
| 3,556,342 | A * | 1/1971 | Guarr | G07F 17/0092 221/2 |
| 4,092,990 | A * | 6/1978 | Bayne | G07D 1/00 221/10 |
| 4,664,289 | A | 5/1987 | Shimizu et al. | |
| 4,801,045 | A * | 1/1989 | Barnhart | A47F 1/08 221/305 |
| 4,930,289 | A | 6/1990 | Fransson et al. | |
| 5,361,937 | A * | 11/1994 | Wiese | A47F 1/08 211/150 |
| 5,481,855 | A * | 1/1996 | Yuyama | B65B 1/06 53/168 |
| 5,651,476 | A | 7/1997 | Percy et al. | |
| 5,709,063 | A | 1/1998 | Yuyama et al. | |
| 5,787,678 | A | 8/1998 | Koike et al. | |
| 5,791,516 | A * | 8/1998 | Wittern, Jr. | G07F 11/42 221/114 |
| 6,012,602 | A | 1/2000 | Yuyama et al. | |
| 6,170,230 | B1 * | 1/2001 | Chudy | B65B 5/103 53/168 |
| 6,202,385 | B1 | 3/2001 | Kim | |
| 6,481,180 | B1 | 11/2002 | Takahashi et al. | |
| 6,497,083 | B1 | 12/2002 | Garwood et al. | |
| 6,644,504 | B2 | 11/2003 | Yuyama et al. | |
| 6,690,998 | B1 | 2/2004 | Yuyama | |
| 6,732,498 | B2 | 5/2004 | Keen et al. | |
| 6,792,736 | B1 | 9/2004 | Takahashi et al. | |
| 6,898,919 | B2 * | 5/2005 | Kim | G07F 11/10 221/123 |
| 6,928,790 | B2 | 8/2005 | Takahashi et al. | |
| 7,040,070 | B2 | 5/2006 | Yuyama et al. | |
| 7,225,597 | B1 | 6/2007 | Knoth | |
| 7,277,776 | B2 * | 10/2007 | Kim | B65B 5/103 700/231 |
| 7,284,578 | B2 | 10/2007 | Monti | |
| 7,360,668 | B2 | 4/2008 | Yuyama et al. | |
| 7,398,895 | B2 | 7/2008 | Kim | |
| 7,455,163 | B2 | 11/2008 | Yuyama et al. | |
| 7,637,078 | B2 | 12/2009 | Ishiwatari et al. | |
| 7,770,355 | B2 | 8/2010 | Inamura | |
| 7,832,591 | B2 * | 11/2010 | Karwacki, Jr. | G06F 19/3462 221/7 |
| 8,234,838 | B2 | 8/2012 | Yasunaga et al. | |
| 8,235,248 | B2 | 8/2012 | Kim | |
| 8,281,955 | B2 | 10/2012 | Farnsworth et al. | |
| 8,406,916 | B2 | 3/2013 | Bentele et al. | |
| 8,579,153 | B2 | 11/2013 | Yuyama et al. | |
| 8,745,961 | B2 * | 6/2014 | Terzini | B65B 65/08 53/415 |
| 9,309,013 | B2 | 4/2016 | Elias | |
| 9,399,543 | B2 * | 7/2016 | Longley | B65D 83/0409 |
| 9,790,017 | B2 | 10/2017 | Yuyama et al. | |
| 9,796,496 | B2 | 10/2017 | Van De Koot et al. | |
| 9,914,554 | B2 * | 3/2018 | Lokkers | B65G 17/12 |
| 10,099,809 | B2 * | 10/2018 | Van Wijngaarden | B65B 57/14 |
| 10,252,826 | B2 * | 4/2019 | Lokkers | B65B 65/08 |
| 10,427,809 | B2 * | 10/2019 | Holmes | G07F 11/165 |
| 10,589,883 | B2 * | 3/2020 | Van Wijngaarden | B65B 35/24 |
| 2001/0001358 | A1 * | 5/2001 | Yuyama | G07F 17/0092 53/131.2 |
| 2002/0162850 | A1 | 11/2002 | Yuyama et al. | |
| 2004/0026442 | A1 * | 2/2004 | Hutchinson | G07F 11/44 221/123 |
| 2004/0261357 | A1 | 12/2004 | Takahashi et al. | |
| 2005/0217208 | A1 | 10/2005 | Cicognani | |
| 2005/0234591 | A1 | 10/2005 | Kim | |
| 2006/0070352 | A1 | 4/2006 | Momich | |
| 2007/0084150 | A1 | 4/2007 | Siegel et al. | |
| 2007/0289660 | A1 | 12/2007 | Aylward | |
| 2008/0222999 | A1 | 9/2008 | Monti | |
| 2008/0223001 | A1 | 9/2008 | Monti | |
| 2009/0056283 | A1 | 3/2009 | Monti | |
| 2009/0133362 | A1 | 5/2009 | Bentele et al. | |
| 2011/0178634 | A1 | 7/2011 | Yuyama et al. | |
| 2014/0298754 | A1 | 10/2014 | Van Wijngaarden | |
| 2015/0083744 | A1 * | 3/2015 | Vogler | A47F 1/126 221/154 |
| 2015/0090733 | A1 | 4/2015 | Park | |
| 2015/0225101 | A1 | 8/2015 | Van Wijngaarden | |
| 2015/0251789 | A1 | 8/2015 | Lokkers et al. | |
| 2015/0298839 | A1 | 10/2015 | Van De Koot et al. | |
| 2017/0197739 | A1 * | 7/2017 | Ha | B65B 39/12 |

FOREIGN PATENT DOCUMENTS

| | | |
|---|---|---|
| JP | 10-338318 | 12/1998 |
| JP | 2001-170136 | 6/2001 |
| JP | 2004-284680 | 10/2004 |
| JP | 2009261932 A | 11/2009 |

OTHER PUBLICATIONS

Written Opinion dated Oct. 30, 2013 for International Application No. PCT/EP2013/067523.

Japanese Office Action dated Dec. 13, 2016 issued in Japanese Application No. 2015-528971 (7 pages).

* cited by examiner

APPARATUS FOR PACKAGING DOSED QUANTITIES OF SOLID DRUG PORTIONS

CROSS-REFERENCE TO RELATED APPLICATIONS

This application is a continuation of U.S. patent application Ser. No. 14/424,494, filed on Feb. 27, 2015, entitled "APPARATUS FOR PACKAGING DOSED QUANTITIES OF SOLID DRUG PORTIONS," which issued on Apr. 9, 2019, as U.S. Pat. No. 10,252,826, which is the U.S. National Phase under 35 U.S.C. § 371 of International Application No. PCT/EP2013/067523, filed on Aug. 23, 2013, which claims the benefit of European Application No. 12 182 632.5, filed on Aug. 31, 2012, the disclosures of which are incorporated herein in their entirety for all purposes.

BACKGROUND

The invention relates to an apparatus for packaging dosed quantities of solid drug portions. In particular, the invention relates to an apparatus for packaging dosed quantities of solid drug portions with enhanced serviceability.

It is advantageous to package dosed quantities of solid drug portions, such as tablets and pills, in bags or other types of packaging, wherein the solid drug portions in each bag are packed separately per ingestion. The bags are provided with user information, such as the day and time of day the solid drug portions have to be taken. The bags for one particular user are usually attached to each other and supplied rolled up in a dispenser box.

The filling of individual packages with dosed quantities of solid drug portions (batches) is increasingly being automated. A known apparatus for dosing solid drug portions for final packaging in individual packages comprises a plurality of supply means respectively provided with different types of solid drug portion. After reading or entering a solid drug portion prescription, the supply means relevant to the prescription are opened in order to allow a dosed quantity of solid drug portions to drop into a central fall duct positioned under the supply means. At the bottom of the fall duct the selectively released solid drug portions are received in a packaging, such as a bag, after which the packaging is closed. Providing the packaging with user information can be realized prior to or following filling of the packaging. 60 packages per minute can be made up in this automated manner. The known apparatus does however have several drawbacks. A significant drawback of the known apparatus is that the filling capacity of the apparatus depends to a considerable extent on, and is limited by, the (longest) drop time of the solid drug portions in the fall duct, whereby the filling capacity of the known apparatus is limited and cannot be increased. However, owing to the permanently increasing demand for solid drug portions there is a need in practice to provide more packages of a dosed quantity of solid drug portions per unit time.

Undisclosed Dutch patent application NL2007384 discloses an apparatus for packaging dosed quantities of solid drug portions, comprising a plurality of dosing stations for dispensing a dosed quantity of solid drug portions, at least one first endless conveyor for moving along at least some of the number of dosing stations a plurality of fall ducts coupled to the first conveyor, wherein each fall duct is adapted to guide a dosed quantity of solid drug portions delivered by at least one supply means, at least one second endless conveyor for displacing a plurality of collecting means coupled to the second conveyor, wherein each collecting means is adapted to receive solid drug portions guided through a fall duct, at least one dispensing station for transferring solid drug portions collected by each collecting means to a packaging for closing, and at least one packaging station for closing the packaging provided with the dosed quantity of solid drug portions.

The apparatus in accordance with NL2007384 has a very high throughput, i.e. a very high number of solid drug portions is guided by the fall ducts. Due to the vast number of solid drug portions guided though the fall ducts, the inner surface of the fall ducts is contaminated with the residues of solid drug portions over time. These residues can be transported to the collecting means and from the collecting means to the bags for the user. To prevent such unwanted transport of residues, the fall ducts have to be cleaned on a regular basis. Before cleaning the fall ducts they have to be removed from the apparatus which is time-consuming and requires a undesirable machine shutdown.

It is therefore the object of the present application to enhance the serviceability of an apparatus for packaging dosed quantities of solid drug portions.

This object is solved by an apparatus for packaging dosed quantities of solid drug portions, comprising

- a plurality of dosing stations, each dosing station having an output opening for dispensing solid drug portions, the dosing stations being arranged in a plurality of vertical or inclined columns,
- and collecting means for collecting dosed quantities of solid drug portions dispensed by the dosing stations and for forwarding the dosed quantities of solid drug portions to a packaging means,
- wherein a plurality of fall ducts is arranged for guiding the solid drug portions from the output openings of the dosing stations of a vertical or inclined column to the collecting means, each fall duct having an outlet and a number of inlet openings, the output openings of the dosing stations being aligned with the inlet openings of the fall ducts when a fall duct is positioned adjacent to a column of dosing stations.

Each fall duct consists of at least a first part and a second part, forming the fall duct when the parts are assembled, wherein the parts being detachably connected together so that the parts can be detached for maintenance and cleaning purposes.

By providing the fall ducts in accordance with the present invention, the serviceability is greatly enhanced as it is no longer necessary to remove the complete fall ducts. For maintenance purposes one part of the fall ducts can be removed and the inner surfaces of the parts can be cleaned.

The input openings can be formed when the first and the second part of the fall ducts are assembled, i.e. each of the parts of the fall ducts provides a number of "partial openings" of the input openings. It is however preferred that one part of the fall ducts comprises the input openings as such a configuration of the parts of the fall ducts eliminates the need of aligning the partial openings of the first and the second parts of the fall ducts.

While the exact configuration of fall ducts depends of the overall structure of the apparatus, it is preferred that the first and the second part of the fall ducts are provided as a base part and a front part, wherein the base part is arranged so as to be connected to a mounting element of the apparatus and the front part is arranged such that it is detachably connected to the base part.

The fall ducts may be stationary, i.e. mounted at specified positions within the apparatus. In this case the collecting means may also be stationary. Using stationary fall ducts/collecting means has the disadvantage that the number of dosing stations assigned to one fall duct/collecting means is limited by the length of the fall duct and/or the size of the dosing station (assuming that the dosing stations are also stationary).

To enhance the number of dosing stations which can dispense a dosed quantity of solid drug portions into a given fall duct, the dosing stations can be movable along a conveyor. However, as it is preferred to use a high number of dosing stations this approach would require a very complex design.

It is therefore preferred that the fall ducts are movable along the columns of dosing stations, wherein the base part of the fall ducts is connected to a mounting element of a first conveyor for moving the fall ducts along the columns of dosing stations, and wherein the collecting means are connected to a second conveyor for moving the collecting means together with the fall ducts.

During the movement, the input openings of the fall ducts are aligned with the output openings of the dosing stations of a column. As soon as the openings are aligned, dosed quantities of solid drug portions can be released from the dosing stations.

The collecting means, which are connected to the second conveyor, are moved, at least as long as portions are received through the fall ducts, in line with the fall ducts, i.e. one fall duct is aligned to one collecting means.

Using mobile collecting means, which in fact function as temporary packages, enables multiple solid drug portion prescriptions to be collected in parallel (simultaneously) instead of serially (successively), whereby the capacity for filling packages can be increased substantially. Particularly advantageous here is that the fall ducts are also given a mobile form and can thus co-displace, preferably at substantially the same movement speed and in the same displacement direction, with the mobile collecting means, this resulting in further time gain and increase in capacity.

While the dosed quantities of solid drug portions drop through the fall duct, the fall duct and an underlying collecting means can be moved further in a continuous manner, usually in the direction of one or more following dosing stations. The following dosing stations can, depending on the prescription to be followed, optionally be activated for the purpose of dispensing a dosed quantity of solid drug portions in the fall duct. In other words, a given fall duct (in line with its collecting means) is moved along the vertical columns of dosing stations and when passing the dosing stations they can be activated. By moving the fall ducts along the vertical columns of dosing stations the number of portions which can dispensed in a given collecting means is greatly enhanced making it possible that even complex and unusual prescriptions can be compiled.

The first conveyor for moving the fall ducts along the vertical columns of dosing stations can comprise one or more conveyor belts, wherein the base parts of the fall ducts are connected to the conveyor belts. Depending on the number of conveyor belts and the length of the fall ducts it is preferred that a mounting beam is arranged between and connected to the base part of each fall duct and the first conveyor. Such a mounting beam can enhance the stability and using the mounting beam allows a wider range of available materials for the fall ducts as the stability requirements for the fall ducts are not that strict when using a mounting beam.

It is preferred that the base part is detachably connected to the mounting beam and/or the mounting beam is detachably connected to the first conveyor to further enhance the serviceability of the apparatus allowing a replacement of separate parts.

The contamination of the fall ducts depends on their length and the number of dosing stations dispensing portions into the fall ducts. In the case that the vertical columns of dosing stations comprise a significant number of dosing stations, the lower section of a fall duct is more contaminated than the upper section of a fall duct as more portions are guided through the lower section. It is therefore preferred that the front parts of the fall ducts comprise a plurality of sub-parts, wherein each sub-part can be detached individually.

The front parts of the fall ducts comprise a plurality of input opening and these input openings are, at least temporarily, aligned with the output openings of corresponding dosing stations. To prevent portions from higher dosing stations entering the output openings of lower dosing stations via an input opening of the front part, the base parts of the fall ducts comprise a number of constrictions, arranged above corresponding input openings in the front parts of the fall ducts to guide falling portions away from the input openings of the front parts and the output openings of dosing stations. Furthermore, the constrictions reduce the fall speed of the individual portions within the fall ducts reducing the risk of damage to the portions.

Maintenance of the fall ducts can be initiated after a given period of time. However, such a constant period might be too short or too long with regards to some of the fall ducts (e.g. for those fall ducts guiding common solid drug portions like mild painkillers). It is therefore preferred that a fall duct comprises a sensor for monitoring the surface characteristics within the fall duct, the sensor being coupled with a control unit arranged within the apparatus.

Alternatively, the number of portions guided through a fall duct can be counted, and depending on the number of guided portions, maintenance can be initiated. For this alternative, a sensor is arranged at the base of a fall duct monitoring the number of solid drug portions being guided through it, the sensor being coupled with a control unit arranged within the apparatus.

To prevent the deposition of solid drug portion residues or other residues, it is preferred that the inner surfaces of the fall ducts are coated with a non-stick coating.

Each collecting means is adapted to collect one prescription associated with one patient. A prescription consists of a predefined quantity and type of solid drug portions formed by tablets or pills and the like. A supply of different types of solid drug portions is held in different dosing stations. The distance between each dosing station and fall ducts co-acting with each dosing station is preferably substantially constant, so that the (fall) time required for transferring solid drug portions from the dosing stations to the adjacent fall ducts is substantially the same, this making it possible to move the collecting means at substantially constant speed. It is however also possible to envisage having the transport speed of the fall ducts and the collecting means depend on the prescriptions to be compiled, and therefore on the dosing stations to be addressed, which can also result in a further increase in the filling capacity.

The dosing stations generally take a stationary form. It is advantageous here for the plurality of dosing stations to be positioned adjacent to each other, this enabling simultaneous filling of the plurality of collecting means. It is also advantageous for the plurality of dosing stations to be positioned above each other, whereby multiple types of solid drug portion can be dispensed simultaneously to the same fall duct and subsequently to the same collecting means, this also enhancing the filling frequency of the apparatus.

It is particularly advantageous here for at least a number of the dosing stations to be arranged in a matrix structure with dosing stations arranged in multiple horizontal rows and dosing stations arranged in multiple vertical columns. It is advantageous here for the dosing stations to be positioned as closely as possible to each other, which in addition to saving volume also results in time gains during filling of the collecting means.

It is further possible to envisage applying a plurality of matrix structures of dosing stations in order to further increase capacity. In a particular embodiment the apparatus comprises two matrix structures, wherein each matrix structure comprises a plurality of dosing stations arranged in rows and columns, and wherein dispensing sides of the dosing stations of the two matrix structures face toward each other. Owing to such an orientation at least a number of fall ducts are enclosed by the two matrix structures.

By causing movement of the fall ducts along the two matrix structures of dosing stations, and in this way along all dosing stations, the required drug portions can be collected in relatively efficient manner.

In one embodiment, the first endless conveyor comprises two parallel endless conveyor belts. In order to stabilize the movement of the fall ducts it is usually advantageous for the apparatus to comprise a plurality of substantially parallel oriented first conveyor belts, wherein each fall duct is connected to a plurality of first conveyor belts. This stability, and particularly the stability in the vertical direction, can be further increased when the apparatus comprises at least one stationary guide, such as a rail, for guiding the movement of the fall ducts.

In one embodiment, the system comprises drive means for driving the first endless conveyor and the second endless conveyor with the same transport speed.

The drive means preferably comprise at least one electric motor. It is advantageous for the drive means to be adapted for simultaneous driving both the first conveyor and the second conveyor. It is possible for this purpose to envisage the at least one first conveyor and the at least one second conveyor being coupled mechanically to each other. This coupling is preferably such that both types of conveyor are moved in the same direction and at the same movement speed. In this way a constant alignment between the fall ducts and the collecting means can be guaranteed as far as possible.

A collecting means and a fall duct lying above may be physically connected to each other or even manufactured in one piece. Alternatively, a collecting means and a fall duct lying above may not be physically connected to each as the decoupling of the two components enhances the flexibility of the apparatus.

Physically separating the collecting means from the fall ducts makes it possible to guide the collecting means away from the fall ducts. In a preferred embodiment, the physical length of the second conveyor is greater than the length of the first conveyor so that the number of collecting means coupled to the second conveyor is greater than the number of fall ducts coupled to the first conveyor. This makes it possible to guide the collecting means along one or more other types of (special) dosing stations for direct dispensing of solid drug portions to the collecting means, that is to say not via the fall ducts.

A collecting means will generally be deemed as a solid drug portion carriage functioning for the purpose of collecting a prescription and transporting the collected solid drug portions to the dispensing and packaging station. It is usually advantageous here for an upper side of each collecting means to take an open form and be adapted to receive a dosed quantity of solid drug portions falling out of a dosing station via a fall duct. The collecting means hereby also serve the function of a collecting tray.

An underside of each collecting means preferably comprises a controllable closing element to enable removal of the solid drug portions from the collecting means. The closing element can be mechanically controllable in the dispensing station. The closing element is however preferably controllable in contactless manner, more preferably by applying magnetism. At least a part of the closing element must however be given a magnetic or magnetisable form for this purpose. Operation of the closing element of such a type can for instance be realized by applying an electromagnet or permanent magnet in the packaging station. In an advantageous embodiment the collecting means comprises biasing means, such as for instance a compression spring, for urging the closing element in the direction of a closed state, whereby erroneous opening of the closing element can be prevented. The dispensing station can in fact form part of the packaging station, wherein dispensing of solid drug portions collected in a collecting means to a packaging for closing can be followed almost immediately by closing of said packaging.

Since each collecting means collects its own prescription, it is desirable to know the location of the fall ducts and the collecting means relative to the dosing stations. For this purpose, use can be made of a calibrating module for calibrating the position of at least one fall duct relative to the first conveyor and/or at least one collecting means relative to the second conveyor. The apparatus can be calibrated by determining a reference or calibration point of at least one fall duct and/or collecting means, since the sequence and the transport speed of the fall ducts and the collecting means are pre-known, as is the length of the first conveyor and the second conveyor. Recognition of a fall duct and/or collecting means by the calibrating module can for instance take place by providing the fall duct and/or collecting means with a unique label. It is however also possible to deem the fall duct and/or collecting means detected at a determined moment by the calibrating module as fall duct and/or collecting means serving as reference.

The packaging station is preferably adapted to seal the packaging. Sealing is understood to mean substantially medium-tight closure of the packaging in order to enable the best possible preservation of the packaged solid drug portions. A (plastic) foil will generally be applied as packaging material and the seal will be formed by a welding process. A separate adhesive, in particular glue, can optionally be applied instead of a weld for the purpose of sealing the packaging. The packaging station is more preferably adapted to realize at least one longitudinal seal and at least one transverse seal, whereby bags are formed which are mutually connected and which in this way form a strip. Because the packaging station is preferably adapted to realize a transverse seal, the length of the bag to be formed can be determined and preferably made dependent on the number and/or the type of solid drug portions to be packaged in a bag. The packaging station will generally be placed a (horizontal) distance from the dosing stations, whereby heat generated by the packaging station will not be transferred, or hardly so, to the dosing stations and the solid drug portions held therein, this increasing the shelf-life of the solid drug portions. The packaging station is usually also provided with a printer for arranging a specific label on each formed packaging.

Each dosing station preferably comprises at least one supply means for solid drug portions, e.g. in tablet form or capsule form or the like, and a dosing element connecting to the at least one supply means. The dosing station as such is usually also referred to as a canister. The dosing element is adapted to separate one or more single solid drug portions from the solid drug portions present in the supply means. Dosing can take place by selectively removing the separated solid drug portions, generally by allowing them to fall, from the dosing element.

In an advantageous embodiment the dosing element is displaceable relative to the supply means between a loading state, in which a receiving space of the dosing element connects to a delivery opening of the supply means, and an unloading state in which the dosing element covers the delivery opening and is adapted to deliver the separated solid drug portion to a collecting means coupled to the conveyor. The dosing element will generally be of substantially cylindrical form, wherein the one or more receiving spaces are arranged in the cylindrical dosing element, wherein each receiving space is generally adapted to temporarily hold one solid drug portion. Such a dosing element is usually also referred to as an individualizing wheel. By means of axial rotation of the cylindrical dosing element the dosing element can be displaced between a loading state, in which a receiving space of the dosing element is aligned with a delivery opening of the supply means, and an unloading state in which the dosing element covers the delivery opening and is adapted to deliver the separated tablet to a fall duct coupled to the first conveyor.

The number of collecting means is preferably greater than the number of columns of dosing stations. In a typical embodiment of the apparatus according to the invention the apparatus comprises up to 3,000 columns of dosing stations and up to 4,500 collecting means. In a preferred embodiment the apparatus comprises 500 columns of dosing stations and 750 collecting means.

The apparatus comprises a control unit for controlling at least the packaging station, the dosing stations, the at least one first conveyor and the at least one second conveyor and the sensors which might be arranged in the fall ducts. It is advantageous here for the control unit to be adapted to determine, on the basis of a desired dosed quantity of solid drug portions, a dosed quantity of solid drug portions to be successively dispensed through time by a plurality of dosing stations via the fall ducts to the collecting means. Because prescriptions are taken as starting point, a logistical conversion must be made to a most efficient method of filling the collecting means, which conversion can be made using the control unit. The control unit can here be coupled or even form part of a computer provided with a computer program, the computer program being adapted to determine a filling schedule for filling the collecting means and subsequently the packages in the packaging station.

BRIEF DESCRIPTION OF THE DRAWINGS

The invention will be described on the basis of non-limitative exemplary embodiments shown in the following figures. Herein.

DETAILED DESCRIPTION

Figure 1:
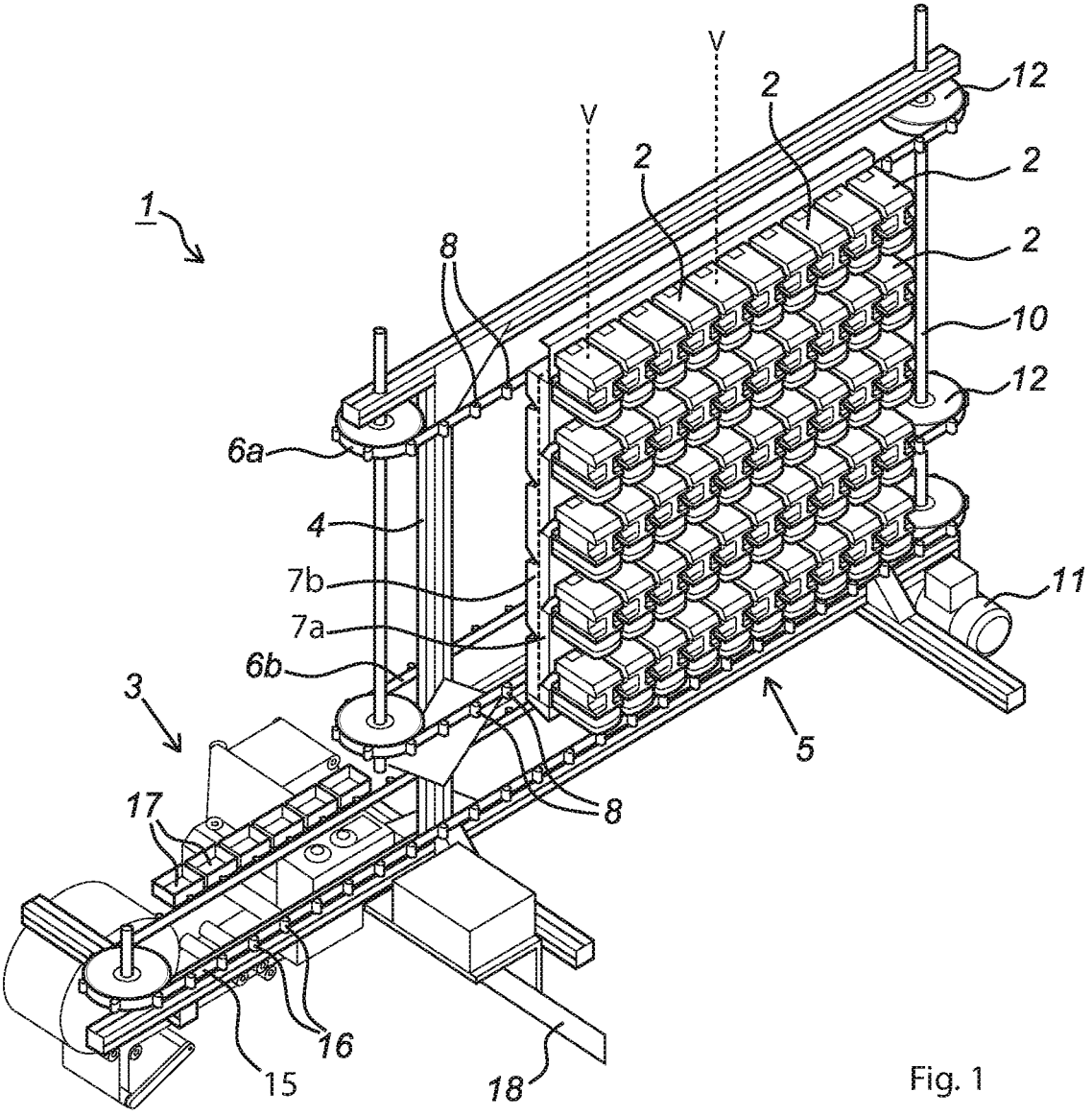
FIG. 1 is a first perspective view of an apparatus according to the invention for transporting dosed quantities of solid drug portions from a plurality of dosing stations to a packaging station.
Figure 2:
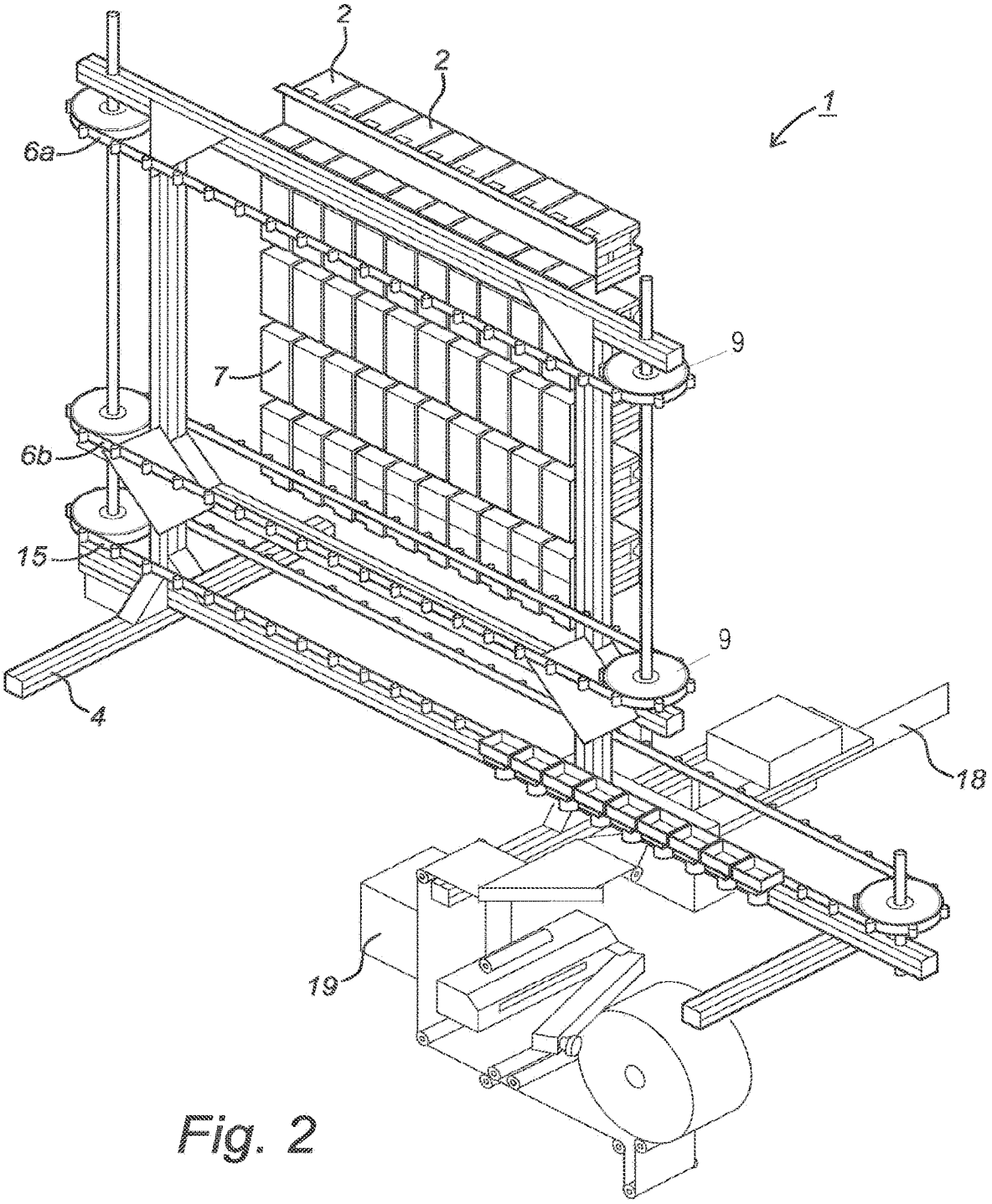
FIG. 2 is a second perspective view of the apparatus according to FIG. 1.
Figure 3:
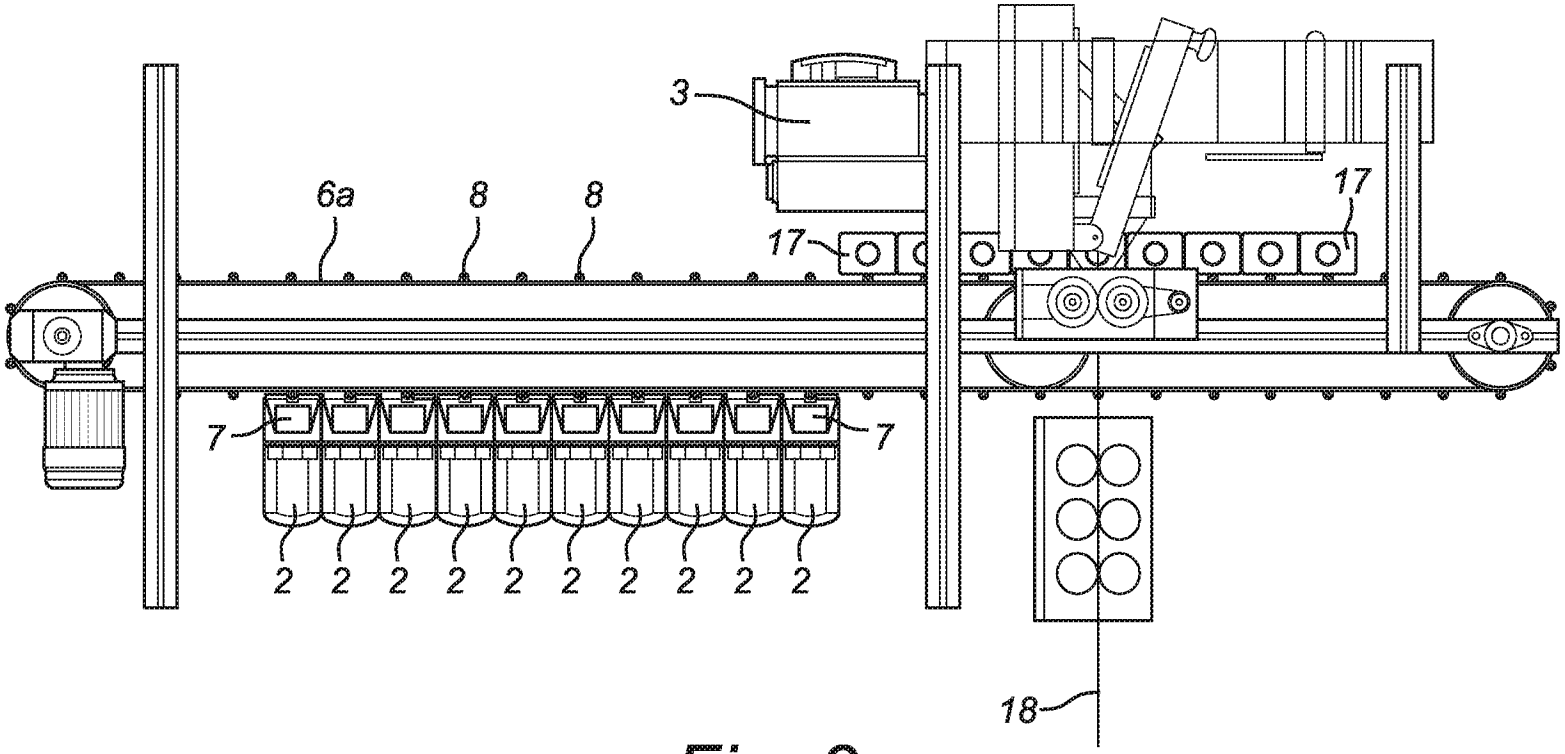
FIG. 3 is a bottom view of the apparatus according to FIG. 1.
Figure 4:
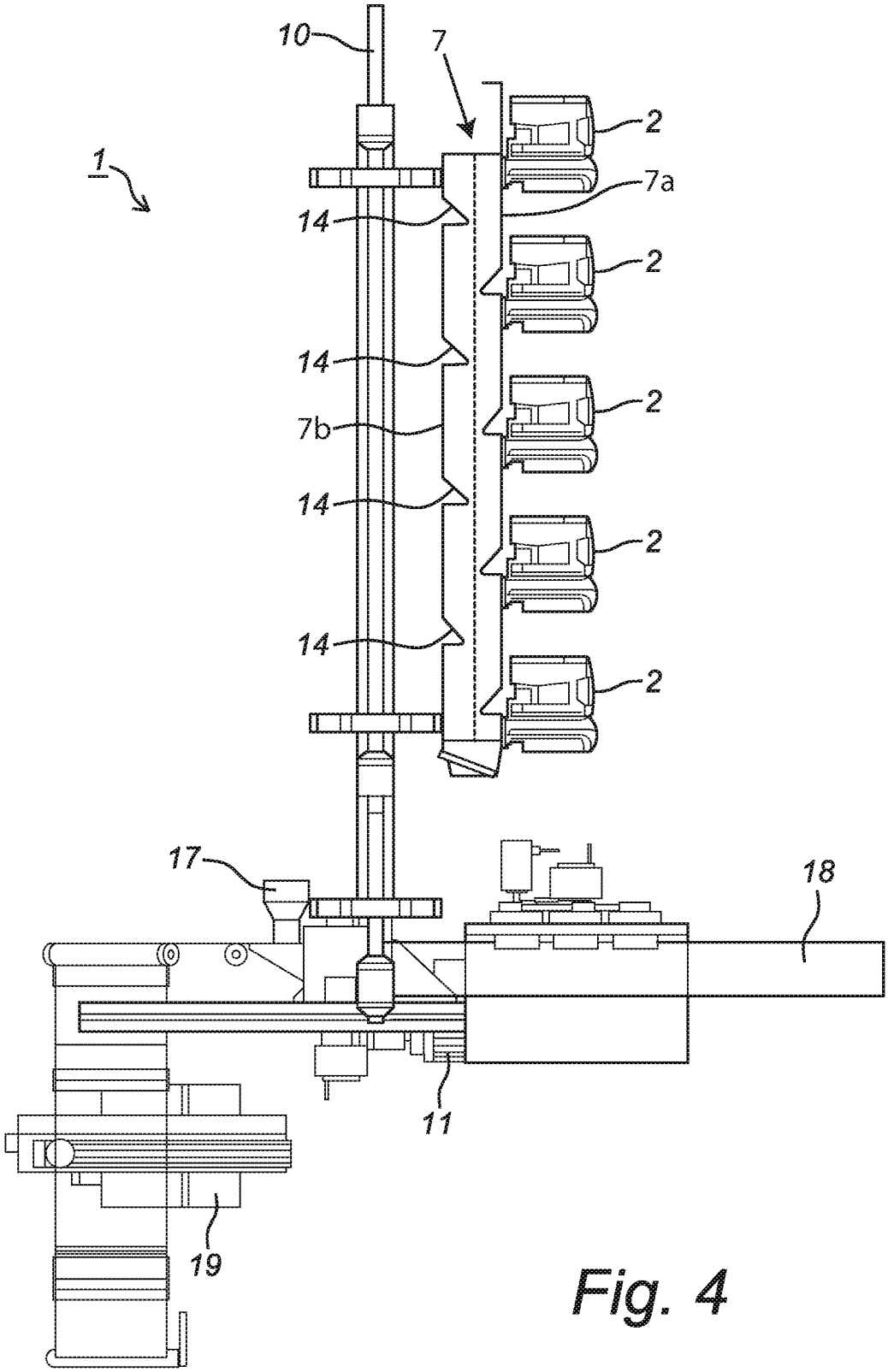
FIG. 4 is a side view of the apparatus according to FIG. 1.

FIGS. 1 and 2 show different perspective views, FIG. 3 shows a bottom view and FIG. 4 shows a side view of a apparatus 1 according to the invention. Apparatus 1 comprises a support structure 4 (frame) to which a plurality of dosing stations 2 is connected in stationary, releasable manner. Each dosing station 2 is adapted to hold a supply of one type of solid drug portions. Different dosing stations 2 will generally hold a supply of different types of solid drug portions, although it is also possible that frequently-dosed solid drug portions are held by a plurality of dosing stations 2. The majority of the number of applied dosing stations 2 are arranged in two matrix structures 5 (of which only a single matrix structure is shown in the figure), which matrix structures 5 together enclose a part of a first endless conveyor, wherein this first conveyor is provided by two first horizontally running conveyor belts 6*a*, 6*b* for fall ducts 7. In this embodiment, fall ducts 7 are mounted releasably on mounting elements 8 forming part of both first conveyor belts 6*a*, 6*b*. In the shown embodiment only a few fall ducts 7 are shown, although in practice each mounting element 8 will generally be connected to a fall duct 7, whereby the first conveyor belts 6*a*, 6*b* are provided all the way round with fall ducts 7. In accordance with the invention the fall ducts 7 comprise at least a first and a second part. These parts are not shown in the FIGS. 1, 2 and 3 but in the FIGS. 6-17 to not overload the separate figures.

The first conveyor belts 6*a*, 6*b* are driven by drive wheels 9 which are coupled by means of a vertical shaft 10 to an electric motor 11. In order to be able to counter slippage of conveyor belts 6*a*, 6*b* the running surfaces 12 of the drive wheels take a profiled form. Through driving of the first conveyor belts 6*a*, 6*b* the fall ducts 7 can be guided along the dosing stations 2 arranged in matrix structures 5 for the purpose of receiving dosed quantities of solid drug portions dispensed by dosing stations 2.

In the shown embodiment each fall duct 7 comprises two parts, a front part 7*a* and a base part 7*b*, and is adapted for simultaneous co-action with a plurality of dosing stations 2 positioned above each other. Each front part 7*a* is provided with a number of input openings 13 (see FIG. 12) corresponding to the number of dosing stations 2 with which fall duct 7 will simultaneously co-act. As can be seen from FIGS. 13-17 the base part 7*b* of a fall duct 7 is also provided with several constrictions 14 for limiting the maximum length of the free fall of falling solid drug portions, in order to limit the falling speed, and thereby limit damage to the falling solid drug portions. Use is generally made here of a maximum free-fall length of 20 cm. The constrictions 14 also guide falling solid drug portion away from the input openings 13 of the front part 7*a* of a fall duct (and therefore from the output opening of the dosing stations) to prevent falling solid drug portion from entering an output opening 13 of a dosing station and sticking there.

The apparatus 1 also comprises a second conveyor belt 15 provided with mounting elements 16 on which a plurality of collecting means 17, also referred to as solid drug portion carriages, are releasably mounted. Each mounting element 16 will generally be provided here with a collecting means 17 adapted for temporary storage of a dosed quantity of solid drug portions made up in accordance with a prescription. Not all collecting means 17 are shown in the figures. The second conveyor belt 15 is coupled mechanically to first conveyor belts 6*a*, 6*b* and is also driven by electric motor 11, wherein the direction of displacement and displacement speed of conveyor belts 6*a*, 6*b*, 15 are the same. It is moreover advantageous for the first conveyor belts 6*a*, 6*b* and the second conveyor belt 15 to be mutually aligned, wherein mounting elements 8, 16 lie in a substantially vertical line (directly under each other). The distance between adjacent mounting elements 8, 16 amounts to 80 mm, this substantially corresponding to the width of collecting means 17, fall ducts 7 and dosing stations 2.

Collecting means 17 are adapted to receive solid drug portions falling through fall ducts 7. Each fall duct 7 is provided for this purpose with a passage opening for falling solid drug portions on the underside. In accordance with this embodiment, for a part of the conveying route each collecting means 17 will be positioned here directly under a fall duct 7. In order to be able to prevent as far as possible sagging of conveyor belts 6*a*, 6*b*, 15 due to the weight of fall ducts 7 and collecting means 17 respectively, conveyor belts 6*a*, 6*b* are tensioned under a bias of about 600 N. Conveyor belts 6*a*, 6*b*, 15 are generally manufactured from a relatively strong plastic such as nylon. As shown in the figures, the second conveyor belt 15 is longer than each of the first conveyor belts 6*a*, 6*b*.

Collecting means 17 will then be guided in the direction of the dispensing and packaging station 3 where the solid drug portions collected in accordance with prescription are removed from collecting means 17, wherein the solid drug portions are transferred to an opened foil packaging 18. In packaging station 3 the foil packaging 18 will be successively sealed and provided with specific (user) information. The overall control of apparatus 1 is realized by applying a control unit 19.

Figure 5:
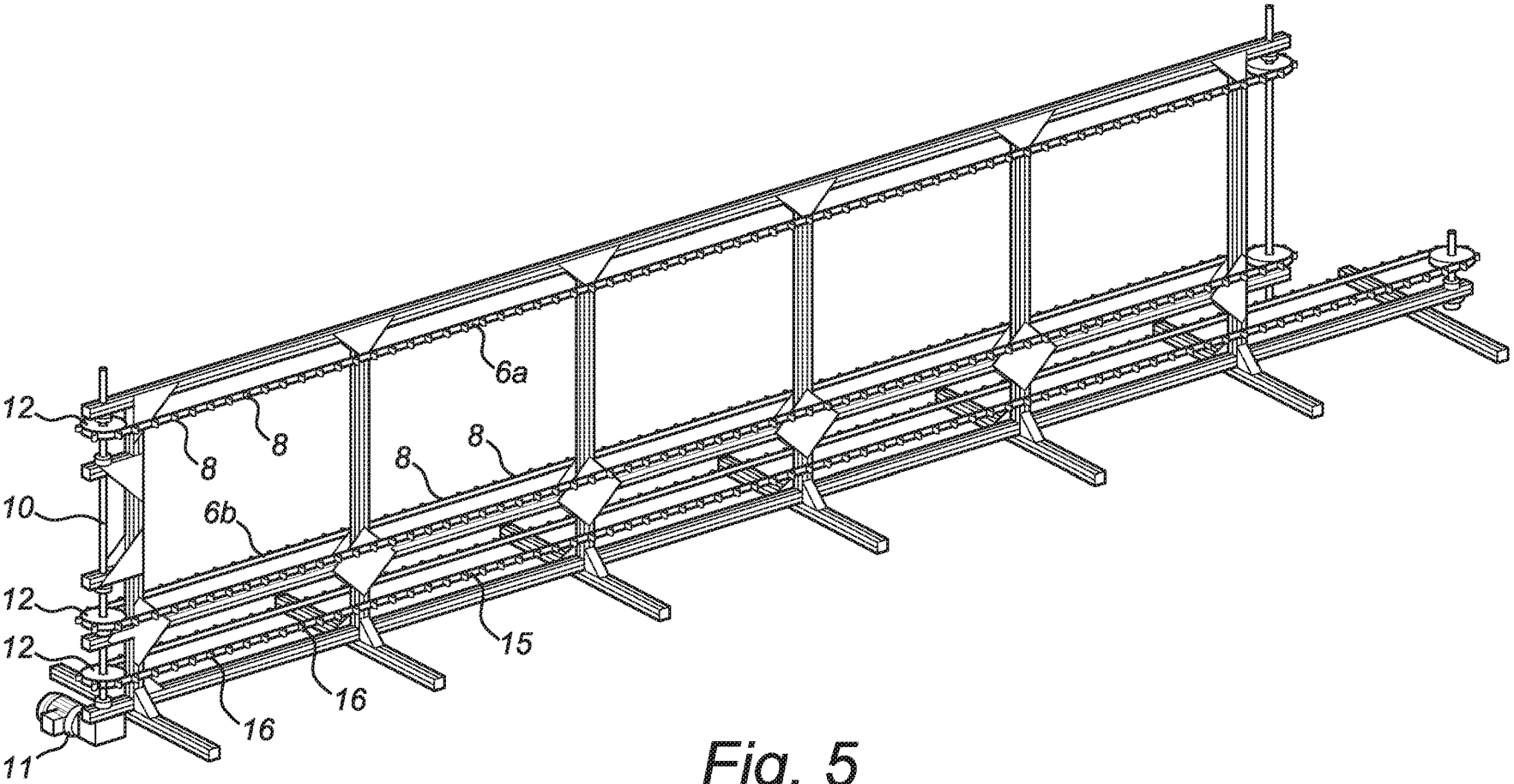
FIG. 5 is a perspective view of the apparatus 1 as shown in FIGS. 1-4.

FIG. 5 is a perspective view of support structure 4 provided with conveyor belts 6*a*, 6*b*, 15 of apparatus 1 as shown in FIGS. 1-4, this in fact forming the heart of the apparatus 1 on which fall ducts 7 and collecting means 17 are mounted and around which dosing stations 2 are then positioned on both longitudinal sides of support structure 4.

Figure 6:
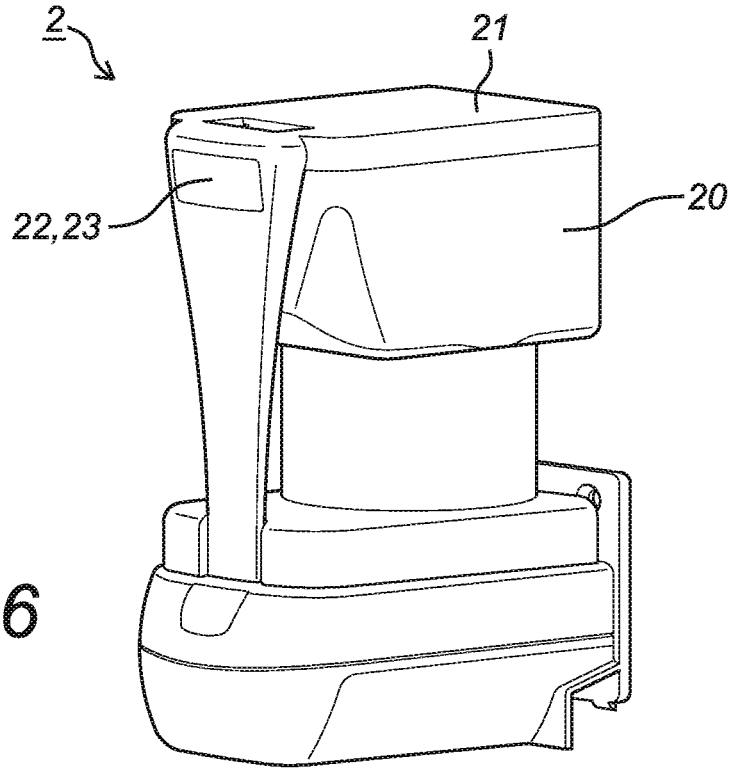
FIG. 6 is a perspective rear view of a dosing station for use in a apparatus as shown in FIGS. 1-4.
Figure 7:
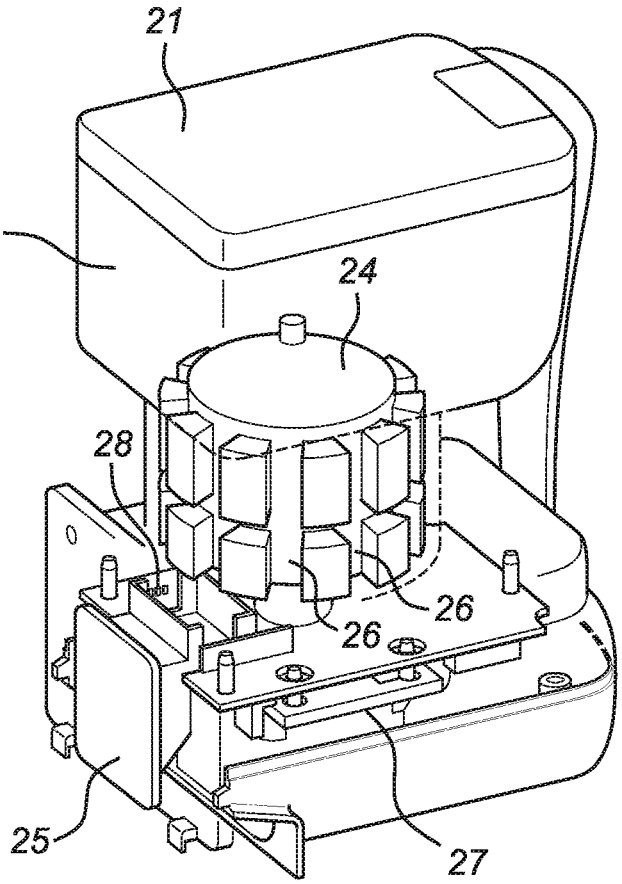
FIG. 7 is a perspective front view of the dosing station as shown in FIG. 6.

FIG. 6 is a perspective rear view of a dosing station 2 for use in a apparatus 1 as shown in FIGS. 1-4. Dosing station 2 is also referred to as a canister, formed by a unit which can be coupled releasably to support structure 4 and which comprises a housing 20 and a cover 21 closing the housing 20. The housing is preferably manufactured at least partially from a transparent material so that the degree of filling of dosing station 2 can be determined without opening dosing station 2. An outer side of housing 20 is provided with a receiving space 22 for a tablet or pill corresponding to tablets or pills held in the housing. Receiving space 22 is covered by means of a transparent cover element 23. An operator can hereby see immediately with which tablets or pills the dosing station 2 has to be filled. In the perspective front view of dosing station 2 as shown in FIG. 7 the housing 20 is shown partially transparently in order to make visible the inner mechanism of dosing station 2. Accommodated as shown in housing 20 is an axially rotatable individualizing wheel 24 which is releasably connected to housing 20 and which is adapted during axial rotation to separate a single tablet or single pill which can subsequently be removed from housing 20 via a fall guide 25 arranged in the housing and can be transferred to a passage opening of a fall duct 7 connecting onto fall guide 25. Individualizing wheel 24 is provided here with a plurality of receiving spaces 26 for pills or tablets distributed over the edge periphery. The size of receiving spaces 26 can generally be adapted to the size of the pills or tablets to be held in supply. Individualizing wheel 24 can be rotated axially by means of an electric motor 27 also accommodated in housing 20. Arranged in fall guide 25 is a sensor 28 which can detect the moment at which a pill or tablet for separation falls, and thereby also whether housing 20 has been emptied. Dosing stations 2 are visible from an outer side of apparatus 1 and accessible for possible replenishment of dosing stations 2. Housing 20 will generally be provided with multiple LEDs (not shown) to enable indication of the current status of dosing station 2, and particularly in the case that dosing station 2 has to be replenished or is functioning incorrectly.

Figure 8:
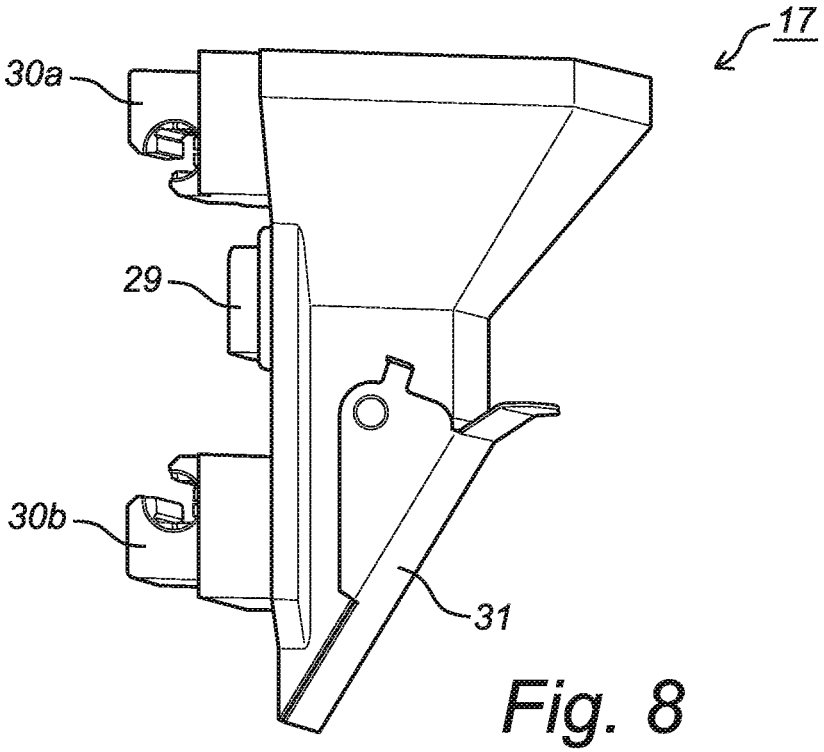
FIG. 8 is a perspective view of a collecting means for use in a apparatus 1 as shown in FIGS. 1-4.
Figure 9:
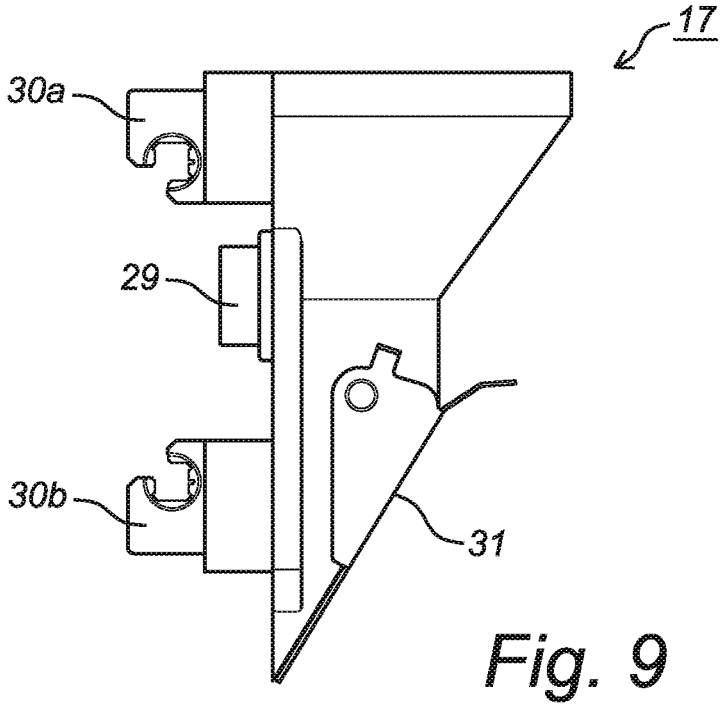
FIG. 9 is a side view of the collecting means according to FIG. 8.

FIG. 8 is a perspective view and FIG. 9 is a side view of a collecting means 17 for use in apparatus 1 as shown in FIGS. 1-4. Collecting means 17 comprises here a mating mounting element 29 for co-action with mounting element 16 of the second conveyor belt 15. In order to increase the stability of collecting means 17, the collecting means 17 also comprises two securing gutters 30*a*, 30*b* for clamping or at least engaging round the second conveyor belt 15. An upper side of collecting means 17 takes an opened form and has a funnel-like shape so that it can receive solid drug portions falling out of a fall duct 7. An underside of collecting means 17 is provided with a pivotable closing element 31 provided with an operating tongue via which the closing element 31 can be pivoted to enable opening, and thereby unloading, of collecting means 17. Collecting means 17 will generally be provided with a biasing element (not shown), such as a compression spring, in order to urge closing element 31 in the direction of the position closing the collecting means 17, whereby erroneous opening of collecting means 17 can be prevented.

Figure 10:
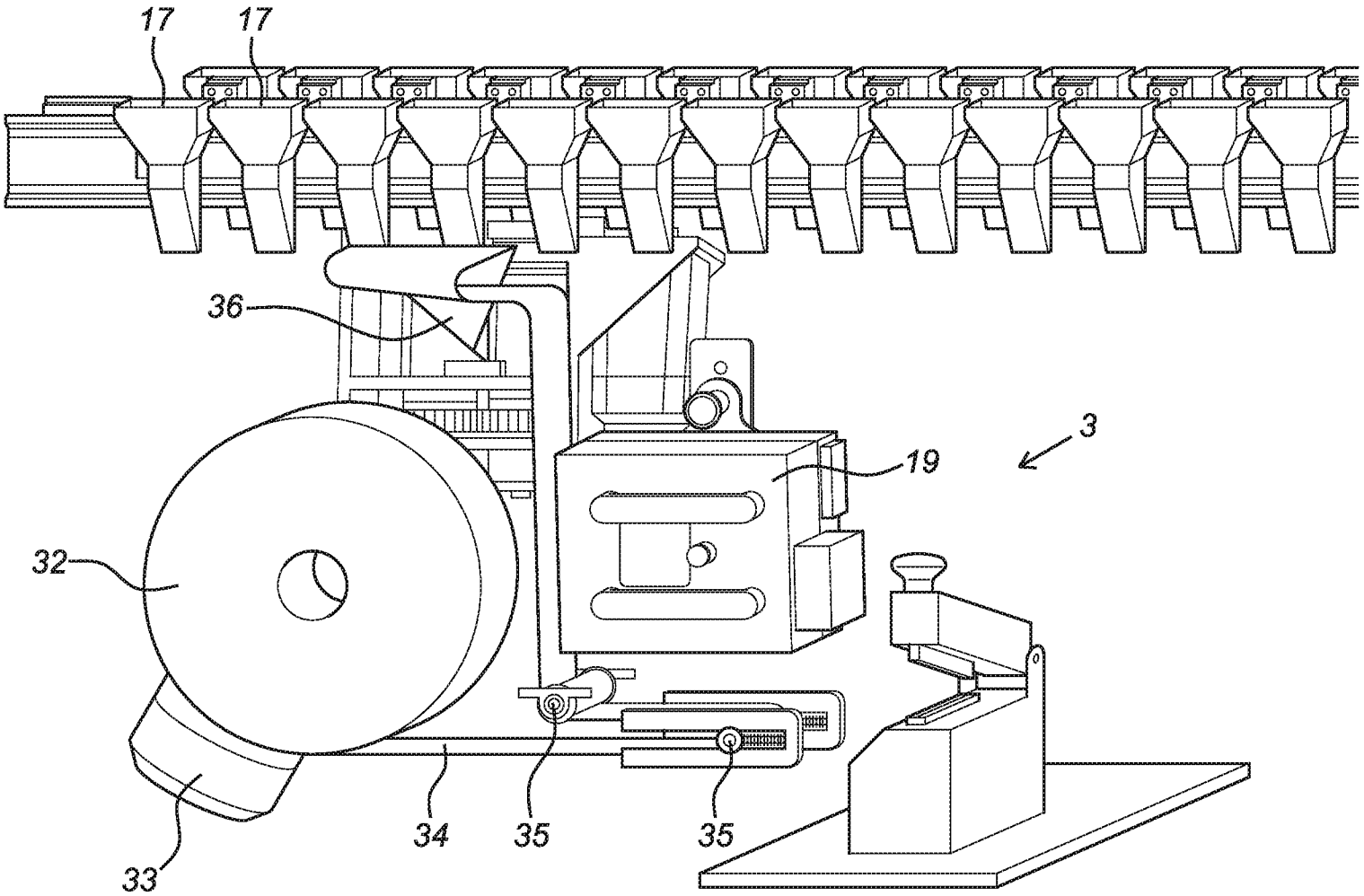
FIG. 10 is a perspective front view of the dispensing and packaging station as applied in the apparatus as shown in FIGS. 1-4.
Figure 11:
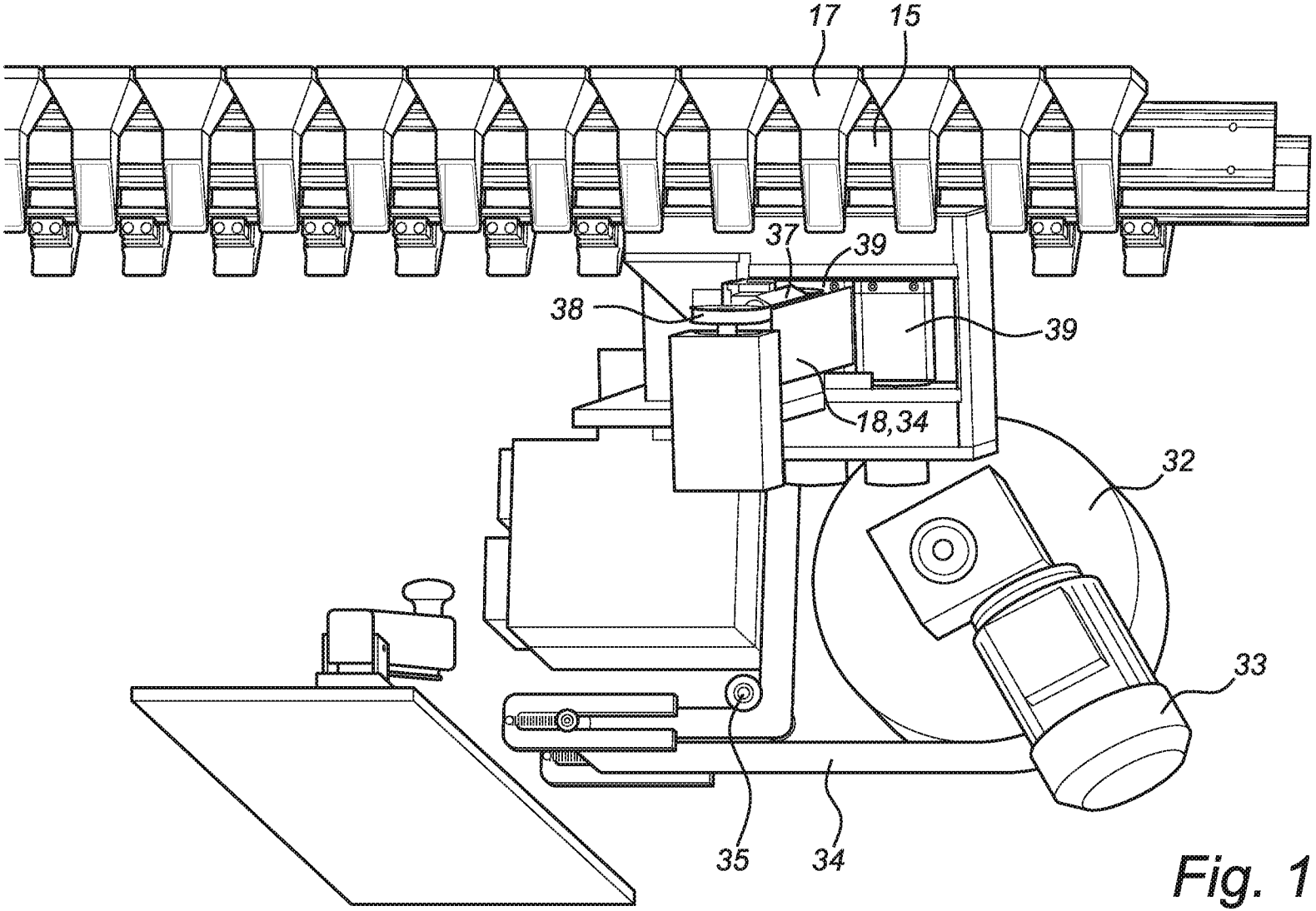
FIG. 11 is a perspective rear view of the dispensing and packaging station according to FIG. 10.

FIGS. 10 and 11 show a perspective front view and perspective rear view of the dispensing and packaging station 3 as applied in apparatus 1 as shown in FIGS. 1-4. Packaging station 3 comprises a foil roll 32 which can be unwound by means of an electric motor 33, after which the unwound foil 34 is guided via a plurality of guide rollers 35 in the direction of the collecting means 17 to be emptied. The transport direction of foil 34 is indicated by means of arrows in both FIGS. 10 and 11. Before foil 34 is transported below a collecting means 17 for emptying, foil 34 is provided with a longitudinal fold, whereby a V-shaped fold 36 is created in which the solid drug portions can be received following opening of collecting means 17. Foil 34 can be provided with two transverse seals and a longitudinal seal to enable complete sealing of packaging 18. Applied in making the longitudinal seal are two heat bars 37, of which only one heat bar 37 is shown, and which press on either side of the two foil parts to be attached to each other, whereby the foil parts fuse together and the longitudinal seal is formed. It is advantageous here for each heat bar 37 to engage foil 34 via a stationary strip manufactured from plastic, in particular Teflon or displaceable band 38 in order to prevent adhesion of heat bars 37 to the foil. The transverse seals are also created by two upright rotatable heat bars 39 which co-act with each other and press the foil parts against each other in realizing a transverse seal. Packaging 18 can optionally be further provided with a label. Successive packages 18 remain mutually connected in the first instance and together form a packaging strip.

Figure 12:
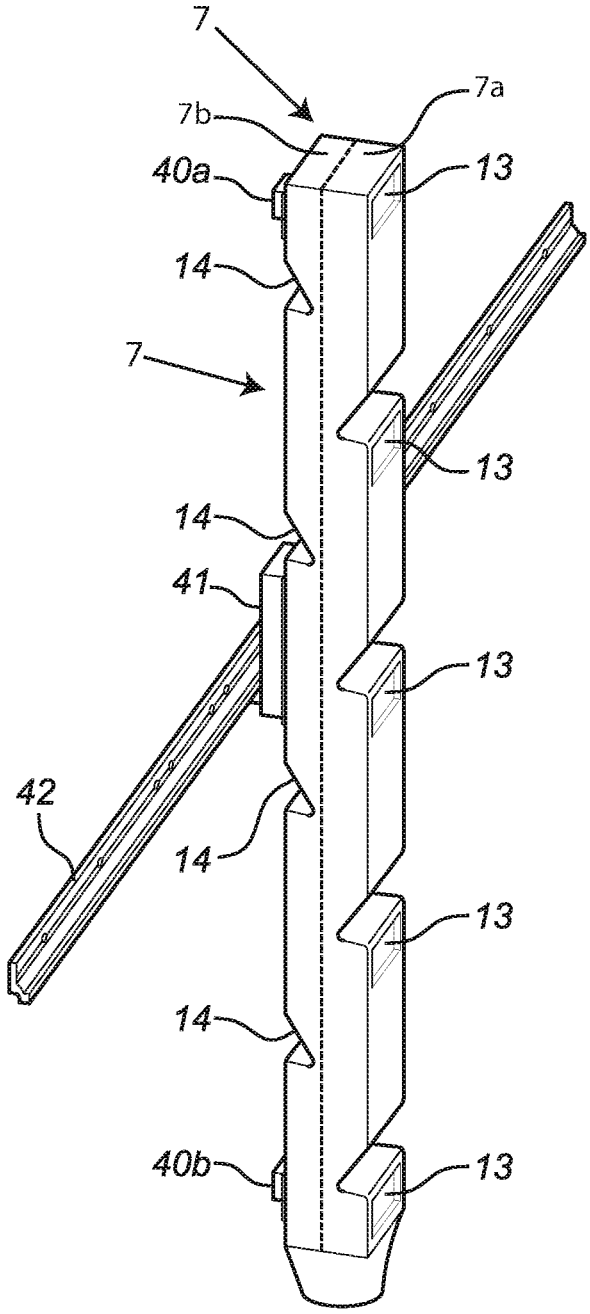
FIG. 12 shows a fall duct as applied in the apparatus according to FIGS. 1-4.
Figure 14:
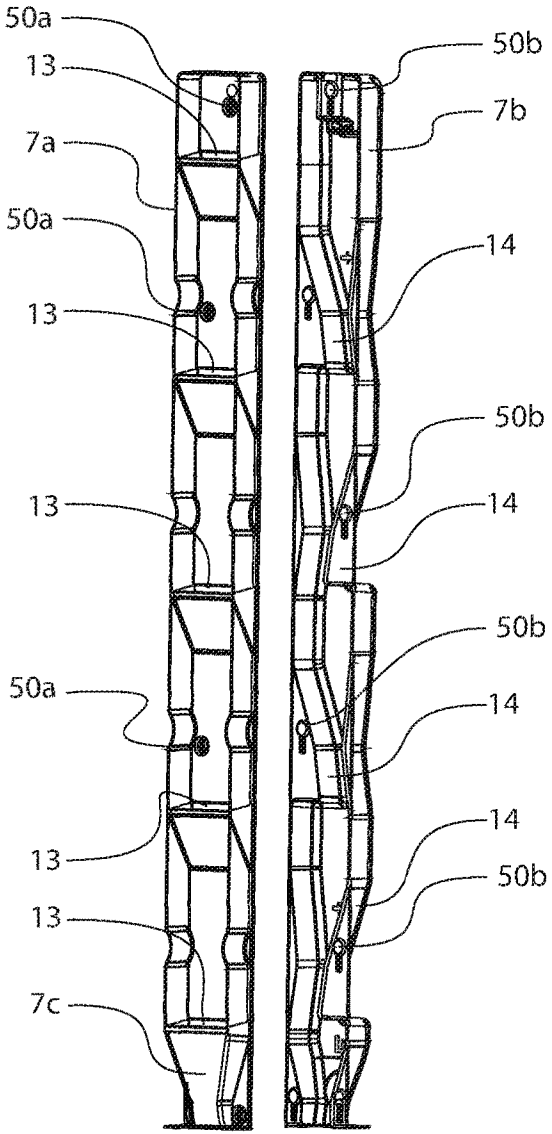
FIG. 14 shows an explosion view of the fall duct according to FIG. 13.
Figure 13:
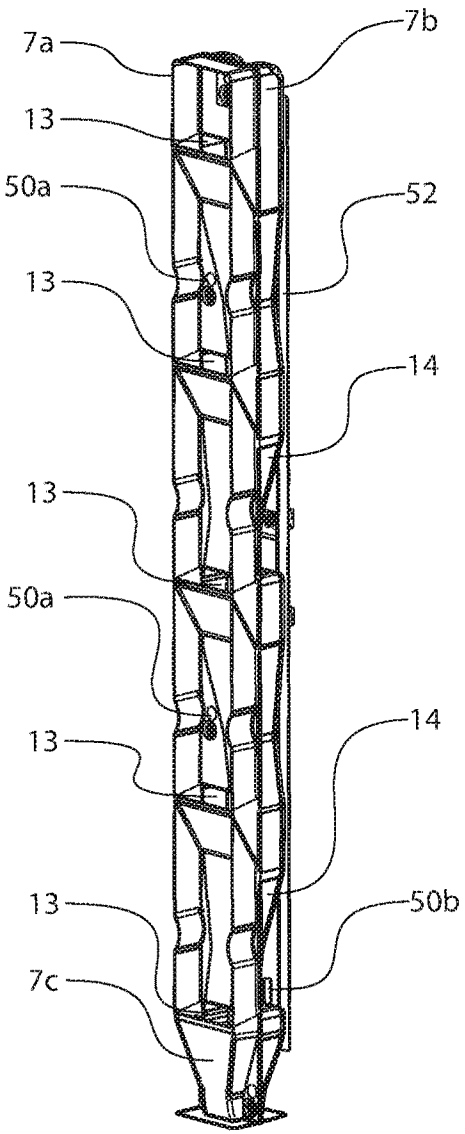
FIG. 13 shows a side view of an embodiment of a fall duct as applied in the apparatus.
Figure 16:
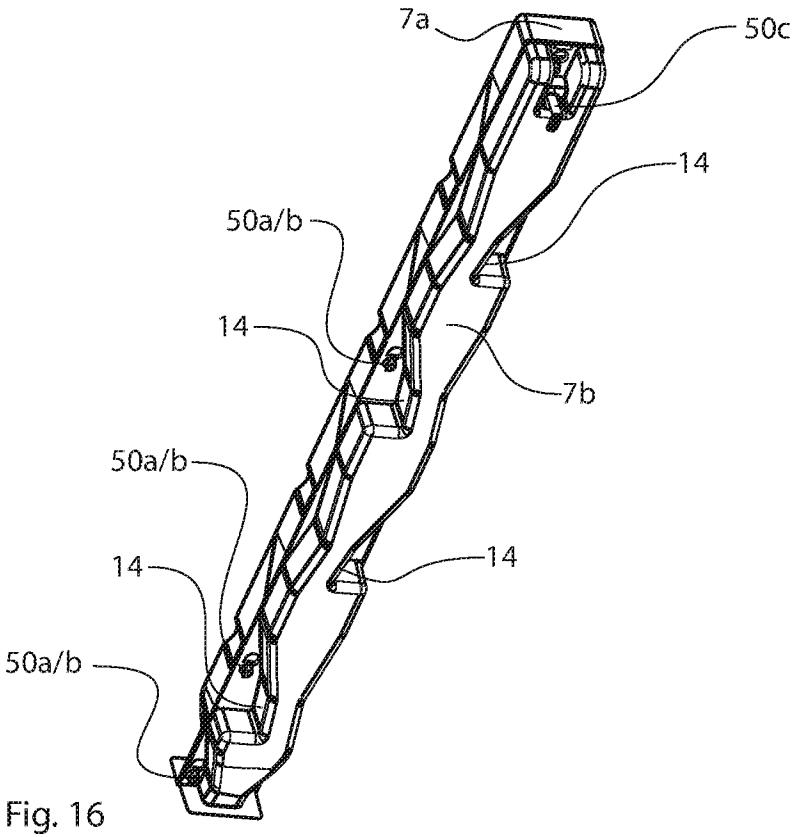
FIG. 16 shows a perspective rear view of the fall duct according to FIG. 13.
Figure 15:
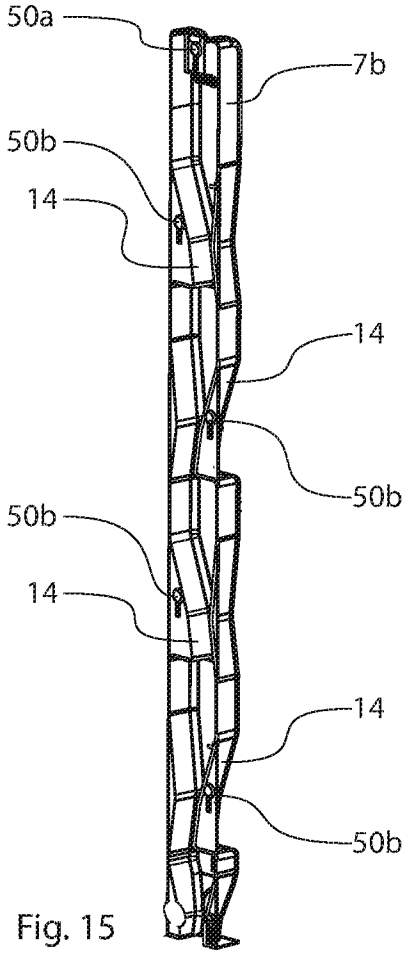
FIG. 15 shows a perspective view of the base part of the fall duct according to FIGS. 13 and 14.

FIG. 12 shows a fall duct 7, the base part 7*b* being provided with two mating mounting elements 40*a*, 40*b* for co-action with mounting elements 8 of the two first conveyor belts 6*a*, 6*b* as applied in an apparatus 1 according to any of the FIGS. 1-4. A particular feature however of the fall duct 7 shown in FIG. 12 is that the fall duct 7 (in this embodiment the base part 7*b* of the fall duct) is provided with an additional central guide element 41 for co-action with a stationary guide 42 which can be attached to support structure 4 of apparatus 1, whereby additional stability is imparted to fall duct 7 and both first conveyor belts 6*a*, 6*b*.

FIGS. 13-17 show various views of an embodiment of a fall duct (or at least a part of the fall duct) in accordance with the present invention, wherein the shown embodiment differs from the embodiment shown in the FIGS. 1-12. As mentioned above, a fall duct comprises at least two parts and in the shown embodiment the at least two parts are provided as base part 7*b* and front part 7*a*. The base part 7*b* is detachably connected to a mounting beam 52 which is detachably connected to a (not shown) conveyor belt of the first conveyor. The front part 7*a* comprises a plurality of input openings 13 which have a kind of funnel shape. The (not shown) dosing stations release dosed quantities of solid drug portions which leave the dosing stations via the output openings and enter the front parts 7*a* of a fall ducts 7 via an input openings 13. The shape/configuration of the input openings is not essential as long as it is ensured that any kind of solid drug portion can pass through it. For example, the input openings can be formed as simple openings in the front part as it is implied in FIG. 12.

The front part 7*a* of the shown fall duct is detachably connected to the base part 7*b* of the fall duct 7. In the shown embodiment the front part 7*a* comprises a number of retainer means 50*a* and the base part 7*b* comprises a number of mating openings 50*b* which have a shape of a long hole in the shown embodiment. The front part 7*a* is also secured by a latching element 50*c* located at the upper part of the fall duct.

To detach the front part 7*a*, the latching element is released and the front part is raised and drawn away from the base part 7*b*. To assemble the fall duct (for example after both parts have been cleaned) the procedure is performed in reverse.

The base part 7*b* of the fall duct 7 comprises a number of constrictions 14 which limit the falling speed of the solid drug portion and prevent falling solid drug portion from entering an output opening of a dosing station by guiding the falling solid drug portion away from the input openings of the front part/the output openings of the dosing stations.

Figure 17:
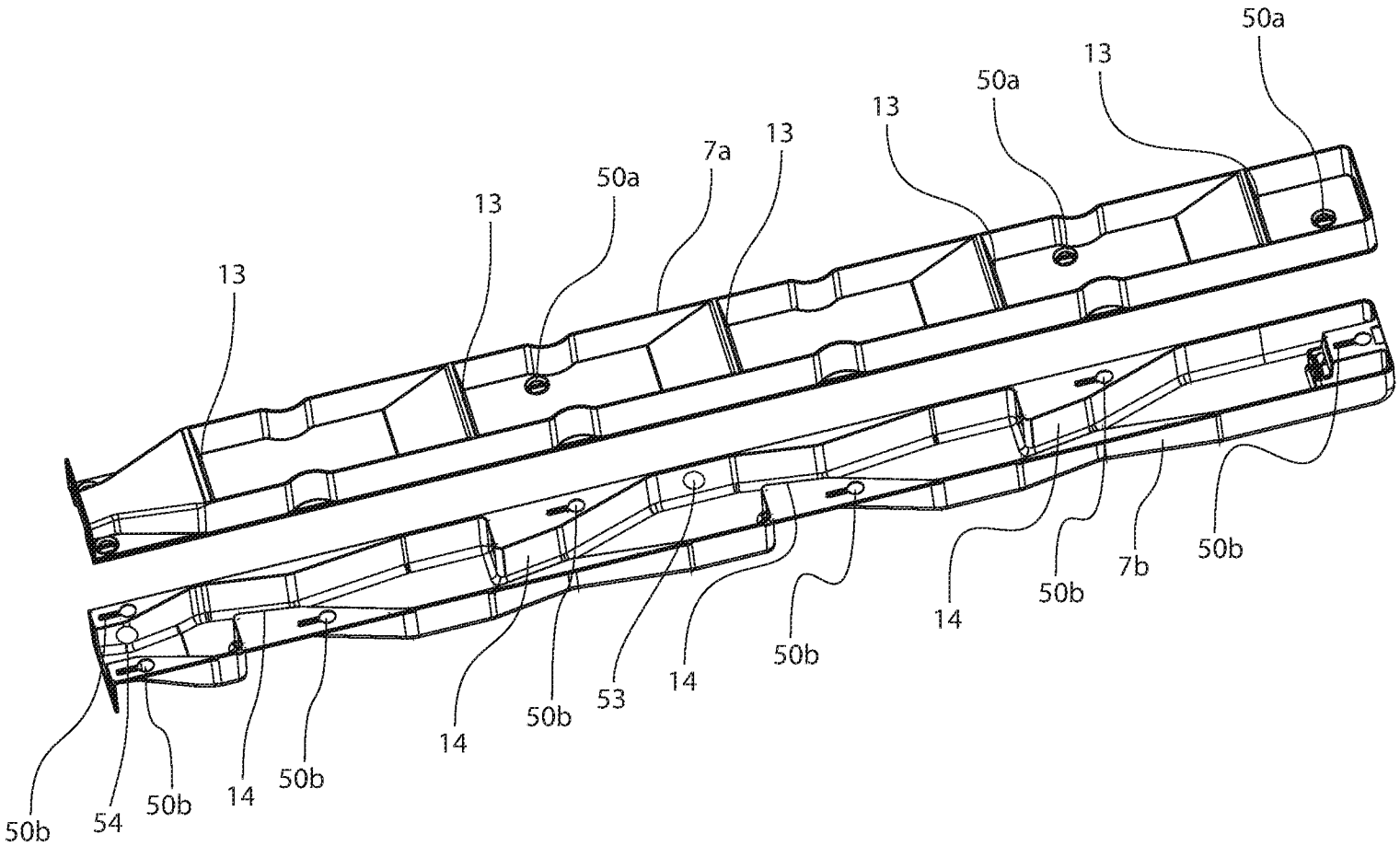
FIG. 17 shows another explosion view of the fall duct according to FIG. 13.

In the shown embodiment the base part 7*b* of a fall duct comprises two sensors 53, 54 (see FIG. 17). Sensor 54 is arranged at the lower section of the base part 7*a* and is arranged to monitor the number of falling solid drug portion. The sensor is coupled with the (not shown) control unit, and the control unit may, depending on the number of solid drug portion units that have passed the sensor 54, initiate maintenance of the fall duct in which the sensor is arranged.

The sensor 53 is arranged somewhere within the base part 7*b* of a fall duct and is adapted to monitor the contamination of the inner surface of the base part. As soon as such contamination exceeds a predetermined limit, the control unit, to which the sensor 53 is also coupled, may initiate maintenance.

It will be apparent that the invention is not limited to the exemplary embodiments shown and described here, but that numerous variants which will be self-evident to the skilled person in this field are possible within the scope of the appended claims.

What is claimed is:

1. A dispensing apparatus, comprising:

a plurality of dosing stations, each dosing station having an output opening;

a plurality of fall ducts, each fall duct comprising a first part detachably connected to a second part opposed to the first part, the first and second opposed parts defining a space for solids falling from the plurality of dosing stations, one of the first and second parts comprising a plurality of inlet openings configured to align with the output openings of the plurality of dosing stations;

a first conveyor; and a plurality of vertical mounting beams connected to the first conveyor, wherein one of the first and second parts is connected to the vertical mounting beam and the other of the first and second parts is detachably connected to the one of the first and second parts connected to the vertical mounting beam, wherein each first part is secured by a latching element, the first part configured to be drawn away from the second part when the latching element is released.

2. The apparatus of claim 1, further comprising a plurality of collectors, each collector configured to receive at least a portion of the solids from a fall duct included in the plurality of fall ducts.

3. The apparatus of claim 2, wherein individual ones of the plurality of collectors are connected to a second conveyor configured to move the collectors together with the fall ducts.

4. The apparatus of claim 1, wherein the vertical mounting beam is detachably connected to the first conveyor.

5. The apparatus of claim 1, wherein one of the first and second parts of the fall ducts comprise a plurality of sub-parts, wherein each sub-part is configured to be detached individually.

6. The apparatus of claim 1, further comprising a sensor disposed within at least one fall duct and configured to monitor surface characteristics within the least one fall duct, the sensor being coupled with a control unit arranged within the apparatus.

7. The apparatus of claim 6, wherein the sensor is disposed on the first part and is configured to monitor contamination of an inner surface of the first part.

8. The apparatus of claim 7, wherein the control unit is configured to initiate maintenance of the at least one fall duct when contamination of the inner surface of the first part exceeds a predetermined limit.

9. The apparatus of claim 1, further comprising a sensor arranged at a base of one of the fall ducts, the sensor configured to monitor a number of solid drug portions being guided through the fall duct, the sensor being coupled with a control unit arranged within the apparatus.

10. The apparatus of claim 9, wherein the control unit is configured to initiate maintenance of the one of the fall ducts when a predetermined number of solid drug portions have been guided through.

11. The apparatus of claim 1, further comprising a sensor disposed within a fall guide of one of the plurality of dosing stations, the sensor configured to detect a moment at which a solid drug portion falls.

12. The apparatus of claim 11, wherein the sensor is configured to detect whether a housing of the one of the plurality of dosing stations has been emptied.

13. The apparatus of claim 1, wherein at least one inner surface of the plurality of fall ducts is coated with a non-stick coating.

14. The apparatus of claim 1, wherein the first conveyor comprises an endless conveyor.

15. A dispensing apparatus, comprising:

a plurality of dosing stations, each dosing station having an output opening;

a plurality of fall ducts, each fall duct comprising a front part and an opposing base part, the front part and the opposing base part arranged to define a space for solid drug portions falling from the plurality of dosing stations, the base part comprising a plurality of constrictions and the front part comprising a plurality of inlet openings configured to align with a plurality of the output openings of the plurality of dosing stations;

a first conveyor; and a plurality of vertical mounting beams connected to the first conveyor, wherein the base parts are connected to the vertical mounting beams and the front parts are detachably connected to the base parts, wherein each front part is secured by a latching element, the front part configured to be drawn away from the base part when the latching element is released.

16. The apparatus of claim 15, wherein the vertical mounting beams are detachably connected to the first conveyor.

17. The apparatus of claim 15, wherein each front part comprises a plurality of sub-parts configured to be detached individually from the opposing base part.

18. The apparatus of claim 15, wherein for each fall duct first and second sensors are disposed on the base part and coupled with a control unit arranged within the apparatus, the first sensor configured to monitor contamination of the fall duct and the second sensor configured to monitor a number of solid drug portions being guided through the fall duct.

19. The apparatus of claim 18, wherein the control unit is configured to initiate maintenance of the fall duct when one of the contamination of the fall duct exceeds a predetermined limit and a predetermined number of solid drug portions have been guided through the fall duct.

* * * * *